United States Patent [19]

Farrell, Jr. et al.

[11] Patent Number: 4,745,530

[45] Date of Patent: May 17, 1988

[54] LIGHT ASSEMBLY AND MOUNTING APPARATUS

[75] Inventors: Mason G. Farrell, Jr., Renton; Craig A. Anderson, Seattle; Douglas K. Garoutte, Federal Way, all of Wash.

[73] Assignee: Target Tech, Inc., Kent, Wash.

[21] Appl. No.: 871,447

[22] Filed: Jun. 6, 1986

[51] Int. Cl.[4] ..... H01R 33/06

[52] U.S. Cl. ..... 362/226; 362/80; 340/87; 439/571

[58] Field of Search ..... 362/61, 80, 226, 311; 339/17 D, 119 L, 125 R, 193 P, 17 LC; 340/84, 87

[56] References Cited

U.S. PATENT DOCUMENTS

| | | | |
|---|---|---|---|
| 1,712,217 | 5/1929 | Kelsea | 362/226 X |
| 2,754,410 | 7/1956 | Thielorn | 362/226 |
| 2,905,925 | 9/1959 | Whiteneck | 340/82 |
| 3,059,231 | 10/1962 | Arneberg et al. | 340/381 |
| 3,446,954 | 5/1969 | Spiteri | 362/226 |
| 3,778,681 | 12/1973 | Wilson | 361/413 |
| 3,805,117 | 4/1974 | Hausman | 339/17 M X |
| 4,047,150 | 9/1977 | Kelley | 340/84 |
| 4,255,005 | 3/1981 | Fukunaga | 339/17 C |
| 4,300,188 | 11/1981 | Addario | 362/226 |

*Primary Examiner*—Samuel Scott
*Assistant Examiner*—Allen J. Flanigan
*Attorney, Agent, or Firm*—Hughes, Cassidy & Multer

[57] ABSTRACT

A light unit having a lower plastic base which is adapted to be fixedly mounted to the exterior of a vehicle, and an upper globe which is screwed to the base. Located inside the light unit is a horizontal circuit board which is connected to the floor of the base by a number of upstanding fasteners. The floor of the plastic base is melded to the metal fasteners each of which includes an upper shaft portion to which the circuit board is secured in electrical contact, and a lower head portion which is located outside the base and which is connected to the vehicle electrical supply to provide electrical power to a light tube inside the globe. The circuit board is removed from the fasteners without having to remove the base from the vehicle or without having to disconnect the electrical wires from the fasteners.

14 Claims, 5 Drawing Sheets

LIGHT ASSEMBLY AND MOUNTING APPARATUS

TECHNICAL FIELD

The present invention relates to a light assembly having component parts which are mounted in a manner to facilitate their removal and/or replacement.

BACKGROUND OF THE INVENTION

It is common for emergency vehicles, repair vehicles, tow trucks, taxis and the like to have mounted lights to warn or advise other motorists and pedestrians of their presence. Typically, these lights are powered by the electrical system of the vehicle through wires which extend from the vehicle electrical system upward through the vehicle roof to the light assembly. Furthermore, in many of these commercially available light units, those component parts which most often require replacement, i.e. the internal electronics and the light bulbs, are attached to the light unit in a manner that their replacement requires removal of the entire light unit from the vehicle. Since typically the base portion of the light unit is fixedly mounted to the vehicle, and the internal electronics are hard wired to the vehicle's electrical system, the replacement of these component parts in conventional commercial light units is time consuming and costly. For example, often these repairs must be done at a repair facility resulting in loss of use of the vehicle until the repair is completed. Furthermore, since the component parts are not readily replaceable, extra light units are often maintained as backups in the event of a failure of one or more component parts. Thus, instead of replacing the component part, the failed light assembly is replaced by the off-the-shelf light unit. In an operation such as a city police force or a utility company, which maintains a large fleet of emergency vehicles, this requirement to maintain a number of spare light units can be quite costly.

Conventional replaceable vehicle light units have been disclosed in U.S. Pat. No. 2,688,688 by Holtz; U.S. Pat. No. 2,825,799 by Julien; and U.S. Pat. No. 3,900,725 by Komon. In Holtz, there is disclosed a replaceable lamp unit for a vehicle which includes a pair of laterally extending electrically conductive fingers which are connected to the vehicle in electrical communication with the vehicle power supply. These fingers are releasably engaged by a complementary pair of laterally extending electrically conductive fingers which are part of the lamp unit so that power can be transmitted between the vehicle and the lamp. On the other hand, Julien discloses a pair of U-shaped resilient connectors which are attached to a light unit and which resiliently engage an upstanding stud which is connected to a base. The base in turn is affixed to the vehicle in a manner that power supply leads from the vehicle electrical system are connected to the upstanding studs for transmitting electrical power to the light unit. Furthermore, in Komon, there is disclosed a navigation light for a boat including a lamp unit which has a lower flange with two female electrically conductive receptacles which slidably engage a pair of upstanding male electrically conductive upstanding members which are attached to a base unit mounted to the boat.

Other conventional light units include U.S. Pat. No. 4,547,840 by Tinder which discloses a holder for mounting a light to a circuit board and which includes a pair of downwardly extending prongs which are engaged within vertical openings in the circuit board. In addition, U.S. Pat. No. 4,415,957 by Schwartz and U.S. Pat. No. 3,530,287 by Husby disclose replaceable lamp units which are removably mounted to a fixedly mounted base.

The Assignee of the present invention has manufactured conventional vehicle light units including a Warn-A-Lite Strobe Model 651 which includes a transparent cover removably mounted to a base having a horizontal upper planar portion and a downwardly depending cylindrical sidewall. A flash tube is mounted to a vertical printed circuit card extending upwardly through a slot in the horizontal upper planar portion. The power supply is mounted to a horizontal printed circuit board which is attached to the base and is hard wired to the vehicle power supply. Removal of the light power supply requires that the base be removed from the vehicle and the connection to the vehicle power supply be severed.

SUMMARY OF THE INVENTION

The present invention pertains to a light assembly having components which are mounted in a manner to facilitate their removal and/or replacement. The light assembly includes a housing which has a light transparent portion and a base which is adapted to be mounted to the vehicle. The housing also includes a cover which is removably attached to the base. Also included in the light assembly is an indicating means located inside the housing. The indicating means includes an indicating member which is mounted to the base and provides a visual output through the light transparent portion of the housing. The indicating means also includes a circuit board which has a conductive portion and electronic components which are mounted to the conductive portion and which are in electrical communication with the indicating member. The electrical components cause the indicating member to generate the visual output in response to an electrical output from the vehicle power supply.

In addition to the housing and indicating means, the light assembly also includes means for fastening the circuit board to a conductive lead from the vehicle power supply in a manner to conduct an electrical output between the vehicle power supply and the circuit board. The fastening means includes an electrically conductive elongated member which has (i) a middle portion mounted in a through-hole in the base wall, (ii) a head portion which faces outwardly from the outer surface of the base wall and which is adapted to be connected to the connecting portion of the conductive lead, (iii) a shaft portion which faces inwardly from the inner surface of the base wall and which engages the circuit board in a manner that the shaft portion is in electrical communication with the conductive portion of the circuit board, and (iv) an end connector which is attached to the shaft portion in a manner that disengagement of the end connector permits the circuit board to be removed from the shaft portion.

In an exemplary embodiment, the light assembly includes a base which is mounted to the vehicle as well as a semi-transparent globe which in cooperation with the base encloses (i) a horizontally mounted circuit board with associated electronic components, and (ii) a vertically mounted printed circuit card which supports a horizontally mounted flash tube. The circuit board is mounted to the base by means of a pair of upstanding electrically conductive fasteners, each of which includes an upper threaded shaft which extends upwardly inside the base and through a hole in the circuit board, and a lower cylindrical head which is melded to the base. The fastener head includes a threaded female receptacle which faces outwardly from the base for receiving a threaded screw fastener to engage an electrical lead which is connected to the vehicle electrical system. Replacement of the circuit board, for example, is accomplished by simply removing the globe, lifting out the flash tube and vertical circuit card, and then removing an end fastener from each shaft to disengage the horizontal circuit board. The base however, remains attached to the vehicle, and the power supply leads remain attached to the vertical fasteners.

It is therefore an object of the present invention to provide a light assembly having component parts which are mounted in a manner to facilitate their removal and/or replacement.

BRIEF DESCRIPTION OF THE DRAWINGS

These and other objects and advantages of the present invention will become more readily apparent upon reading the following Detailed Description and upon reference to the attached Drawings in which.

Figure 1:
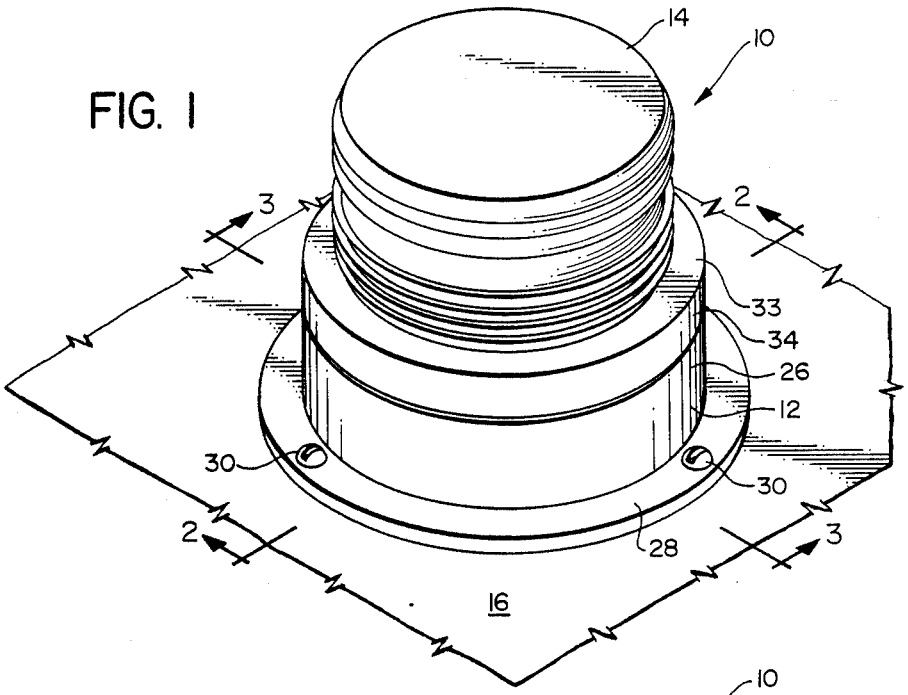
FIG. 1 is an isometric view of the light assembly of the present invention.

While the present invention is susceptible of various modifications and alternative forms, specific embodiments thereof have been shown by way of example in the Drawings and will herein be described in detail. It should be understood, however, that it is not intended to limit the invention to the particular forms disclosed, but on the contrary, the intention is to cover all modifications, equivalents and alternatives falling within the spirit and scope of the invention as expressed in the appended claims.

DETAILED DESCRIPTION OF THE INVENTION

Figure 2:
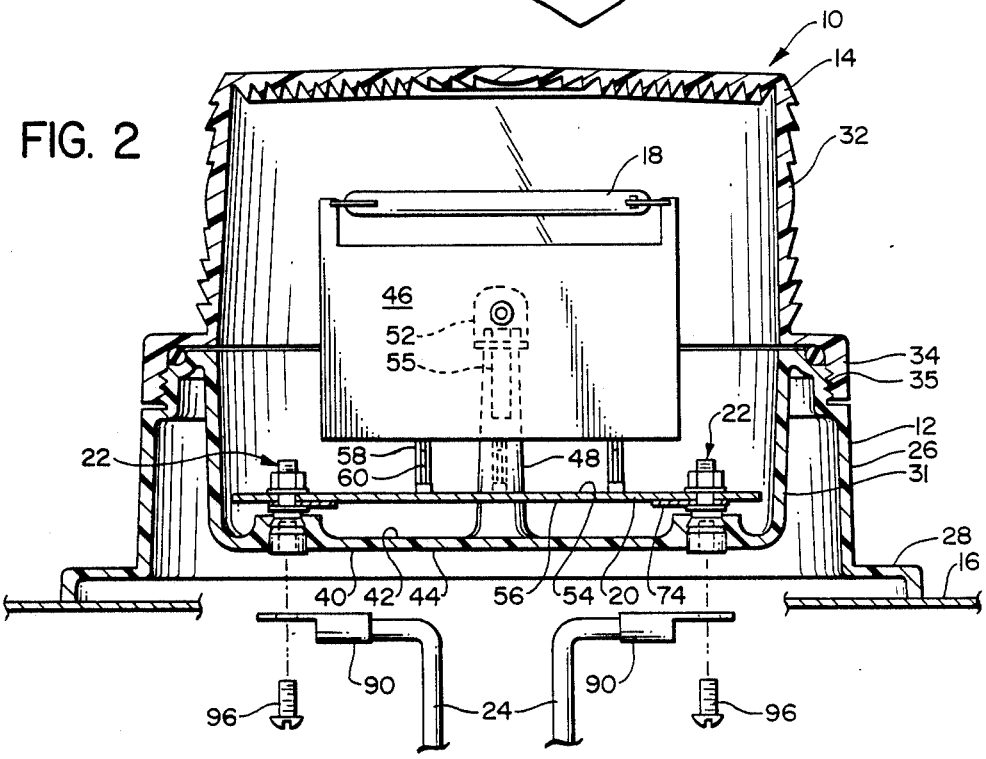
FIG. 2 is a side sectional view of the light assembly taken along line 2—2 of FIG. 1.

Before proceeding with a detailed discussion of the present invention, the principal elements will be identified by first referring to FIG. 1. These elements include a light unit indicated at 10 which includes a plastic lower base 12, an upper semi-transparent globe 14 and a rubber O-ring (not shown) which is engaged therebetween. The base 12 is mounted to an outer surface 16 of a vehicle, watercraft or the like. As shown in FIG. 2, inside the lamp unit 10 there is a light tube 18 which is in electrical communication with a horizontal printed circuit board 20. Circuit board 20 supports a number of conventional electronic components two of which are capacitors shown at 21 which cause the light tube 18 to function in the desired manner. The circuit board 20 is connected to the base 12 above the lower surface of the base by upstanding fasteners indicated at 22. These fasteners are electrically connected to wires 24 which in turn are connected to the vehicle's electrical system in order to power the light tube 18. As will be discussed in further detail later, fasteners 22 perform several functions, which are, namely 1) to secure the circuit board 20 to the base 12, 2) to secure wires 24 to the base 12, and 3) to provide a conductive electrical connection between the wires 24 and the circuit board 20.

Referring now to the light unit 10 in more detail, base 12 (FIG. 1) includes an outer cylindrical upstanding sidewall 26 having a lower laterally extending circular flanged portion 28 which is supported on vehicle surface 16. In an exemplary embodiment shown in FIG. 1, base 10 is rigidly mounted to vehicle surface 16 by threaded screws 30 which extend downwardly through flanged portion 28 into openings (not shown) in vehicle surface 16 where they are engaged by threaded fasteners (also not shown). Other means for mounting the base 12 to the vehicle surface 16, such as external brackets, suction cups and the like are also within the scope of the present invention. In the present embodiment, lamp unit 10 is a warning light which is typically attached to the roof of the vehicle to operate in a flashing mode. However, the present invention is much broader in scope and pertains to any light unit which is typically mounted to the exterior body of a vehicle, boat or the like.

Enclosure of the light tube 18 and associated electronic components is accomplished by an inner upstanding sidewall 31 (FIG. 2) which is located concentrically inside of outer sidewall 26 and which is integrally joined with sidewall 26 at their respective top portions. Base 12 is further formed by a lower laterally extending floor 40 having an upper surface 42 and a lower surface 44 and which is integrally joined to the lower end of sidewall 31. Since outer sidewall 26 has a larger vertical dimension than inner sidewall 31, floor 40 is supported above vehicle surface 16.

To permit convenient access to the inside portion of lamp unit 10, light globe 14 has a downwardly depending cylindrical sidewall which at its lower end includes an L-shaped flanged portion 34 which is internally threaded. This internally threaded portion of globe 14 engages an external circumferential threaded portion 35 at the upper end of an upstanding circular sidewall 26 of base 12.

Figure 3:
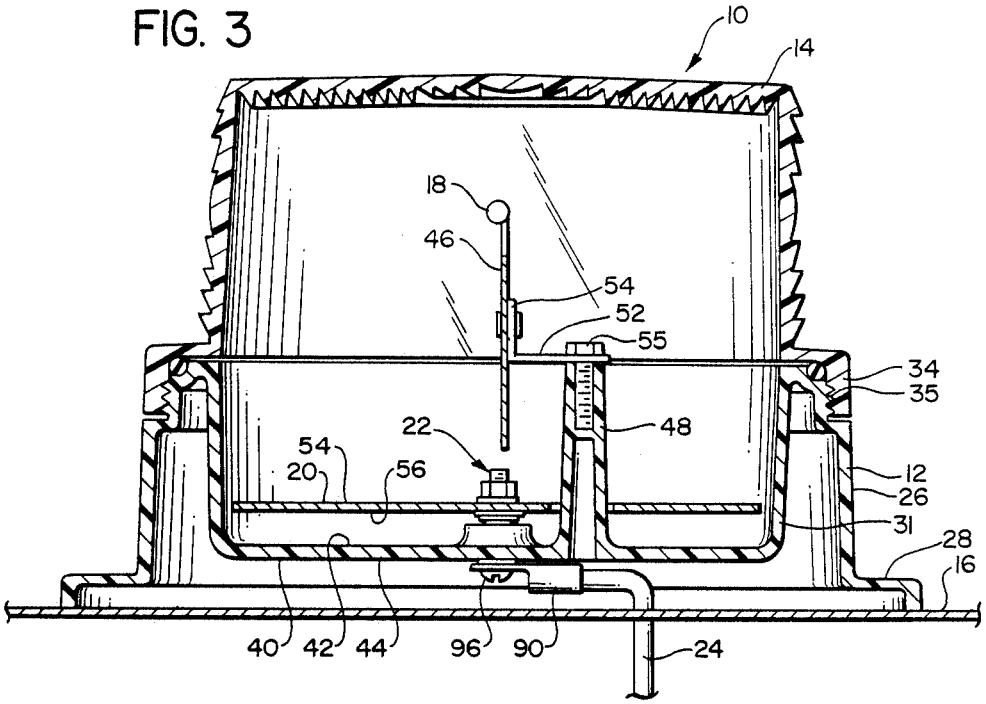
FIG. 3 is a side sectional view of the light assembly taken along line 3—3 of FIG. 1.

Referring to FIGS. 2 and 3, there is supported inside lamp unit 10 at the upper end of a vertical printed circuit card 46, a flash tube 18 which extends laterally between opposite, upstanding end portions of card 46. In turn, card 46 is supported above floor 40 by an upwardly extending post 48 which extends through a vertical hole in the circuit board 20. The lower end of post 48 is fixedly mounted to upper surface 42 of floor 40, and the upper end of post 48 includes a vertical self threading receptacle. Vertical card 46 is mounted to the top of post 48 by means of an L-shaped bracket 52 having a vertical portion 54 which is riveted to the surface of the card 46, and a lower horizontal portion which is connected to the top of post 48 by means of a vertical threaded screw 55 which is engaged within the self threading receptacle of post 48.

The electronic components for powering light tube 18 in a manner that light tube 18 is driven at a selected interval and intensity to achieve short intermittent bursts of light are mounted on printed circuit board 20. These conventional electric components are not shown in the Drawings for ease of illustration. However, the fact that these components are fixedly attached to circuit board 20 is important in that it facilitates their rapid replacement by the simple removal and replacement of the circuit board 20 as a modular component. In addition, the failure of any one electronic component generally requires removal of the entire circuit board for repair and/or replacement. The circuit board 20 includes electrically conductive regions on its lower surface 56 for feeding electrical signals between the electrical components mounted on the circuit board and to provide contact locations for feeding signals to and from the circuit board 20.

Electrical signals from the circuit board 20 travel along three electrical connectors 58 which depend downwardly from the lower edge of insulating card 46. Connectors 58 have sleeve-like configurations in order to axially slidably engage electrically conductive upstanding pins 60, the lower ends of which are connected to the conductive portion of the lower surface 56 of the printed circuit board 20. To supply electrical signals to flash tube 18, connectors 58 are in electrical contact with the ends of flash tube 18 by means of conductive elements mounted to the surface of vertical card 46.

As mentioned previously, circuit board 20 is mounted to base 12, in a manner that its plane is generally parallel to floor upper surface 42, by means of metal fasteners 22. As shown more clearly in FIG. 4, each fastener 22 includes a cylindrical lower portion 64 and an upper portion which includes a cylindrical threaded shaft 66 with a vertical longitudinal axis designated by a line 67. Shaft 66 extends upwardly through a vertical opening 68 in the circuit board 20. Where shaft 66 joins the lower portion 64 of fastener 22, there is an outwardly extending circular shoulder 70 which supports a conductive lock washer 72 having corrugated upper and lower surfaces. Conductive washer 72 is supported on shaft 66 between shoulder 70 and a conductive pad 74 mounted to the lower surface 56 of the circuit board 20, in order to form a nonoxidizing electrical contact therebetween. Conductive pad 74 is in conductive contact with the conductive region of circuit board 20 in order to conduct electrical signals between fastener 22 and the circuit board 20. To secure circuit board 20 on shoulder 70 of fastener 22, a nut 78 and a lock washer 79 are mounted to shaft 66 against the upper surface 54 of circuit board 20.

Continuing with a discussion of the fastener 22, the lower portion 64 is melded within a vertical hole of base floor 40 by means of conventional ultrasonic techniques which cause the plastic material of the floor in the area of the vertical hole to liquify and bond to the lower portion 64 of the metal fastener 22. To enhance the bond between the floor 40 and the fastener 22, particularly in response to forces in both the upward and rotational directions, the lower portion 64 includes a pair of downwardly inclined circular lips 80 which extend about the circumference of the lower portion 64. The inclined lips 80 resist upward displacement of the fastener 22 with respect to its mounted location within the floor 40 when a tightening force is applied via nut 78. Below lips 80 are a plurality of closely spaced inclined grooves 82 each of which has a substantial alignment component which is parallel to longitudinal axis 67, and which are located circumferentially about the outer surface of lower portion 64. To resist a rotational force applied to fastener 22 about its longitudinal axis 67 in a counterclockwise tightening direction, looking downward along axis 67 in FIG. 4, each groove 82 is inclined upwardly in the direction of tightening rotation. The direction of tightening rotation will become clearer by referring to FIG. 4 which shows a flat bottom surface 86 of fastener 22 including a threaded vertical receptacle 88 which extends axially along longitudinal axis 67 within lower portion 64. To attach a conventional electrical fastener 90, having a planar flange tip 92 and a hole 94, to the bottom surface 86, a threaded screw 96 is engaged through hole 94 and into receptacle 88. The inclined grooves 82 resist the rotation of fastener 22 within base 14 caused by the tightening of screw 96. Fastener 90 is also connected to the wire 24 which in turn is connected to the vehicle electrical system in order to supply power through the fastener 22 to the flash tube 18. Wire 24 typically extends upwardly through vertical openings (not shown) in the roof of the vehicle.

Figure 4:
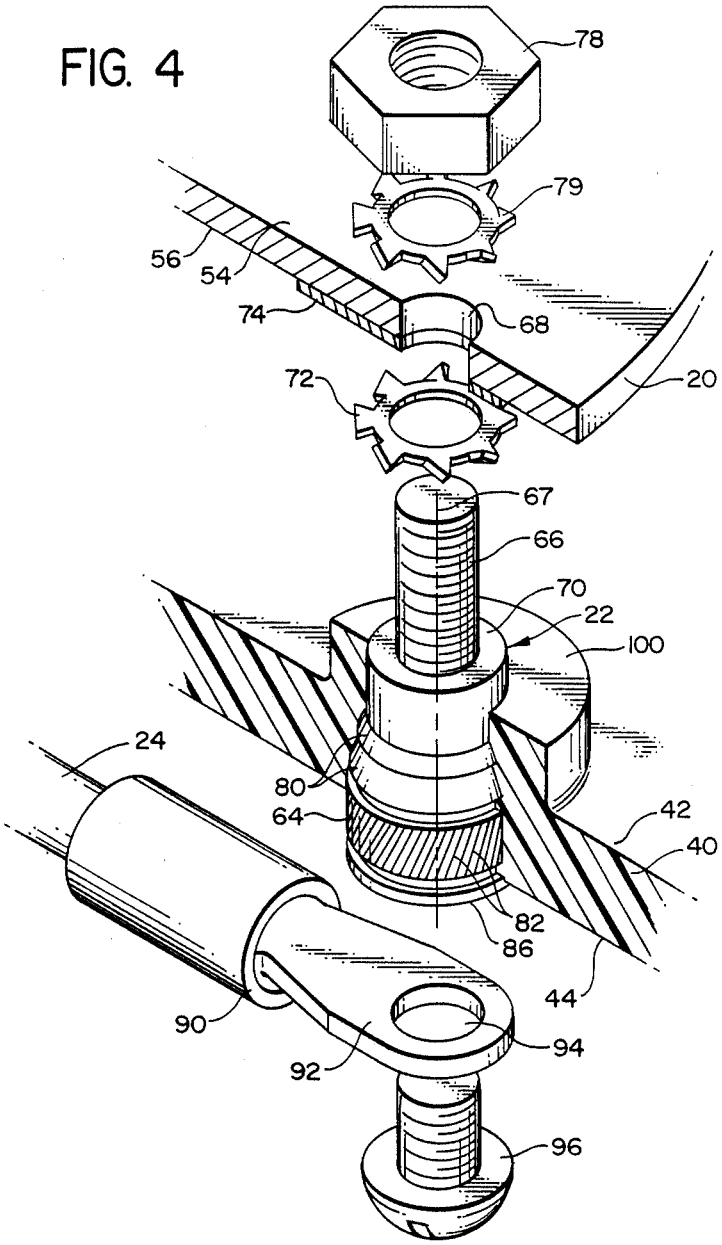
FIG. 4 is an exploded view of the light assembly showing a portion of the base and horizontal circuit board in section, and showing isometrically an electrically conductive mounting fastener for connecting a power lead and the circuit board to the base.
Figure 5:
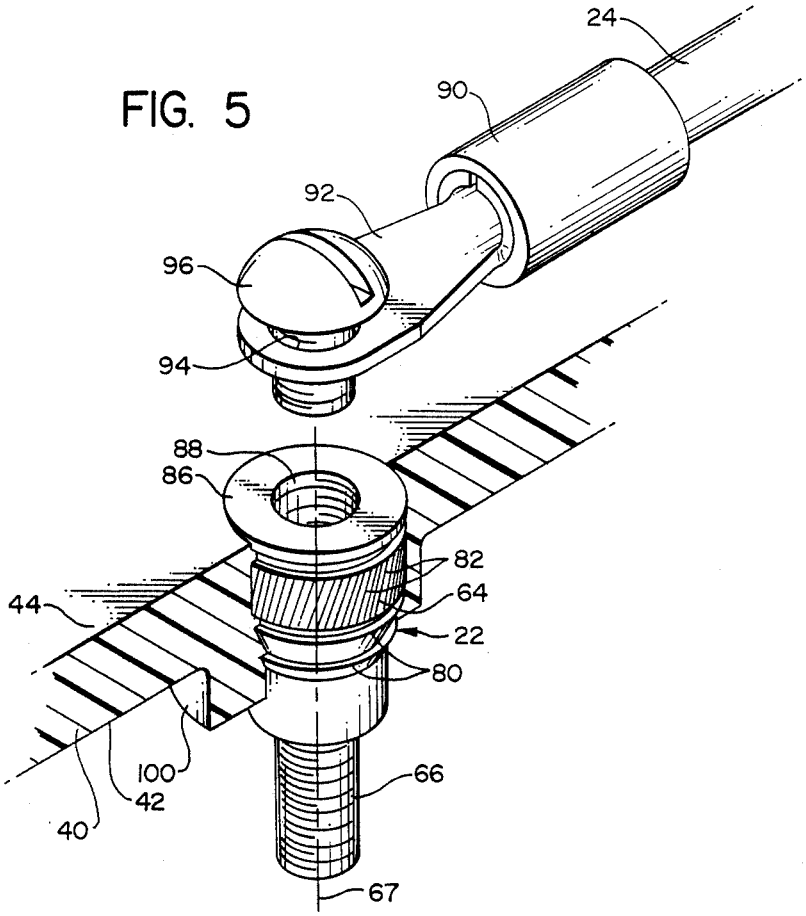
FIG. 5 is an isometric view of the mounting fastener in an inverted position and showing a female slotted receptacle in the lower part of the fastener.
Figure 6:
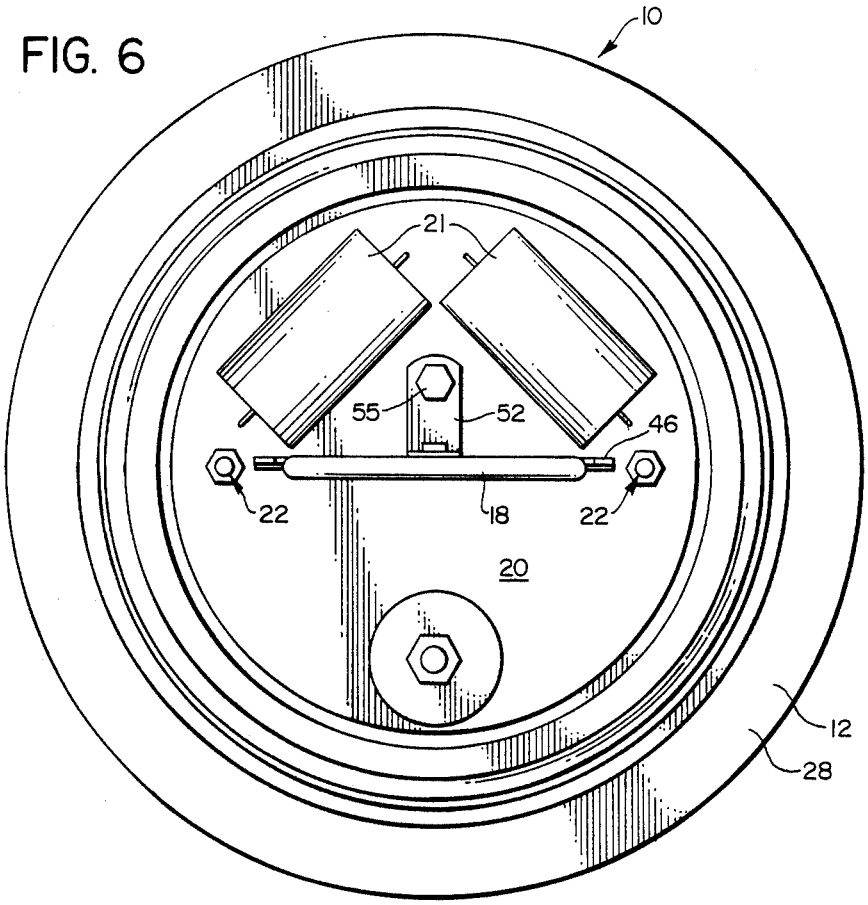
FIG. 6 is a plan view of a circuit board showing a number of conventional electronic components such as resistors, transistors and capacitors which cause the apparatus to function in the desired manner.

As shown more clearly in FIG. 4, to aid in joining fastener 22 to base floor 40, the floor includes an integral upstanding cylindrical portion 100 which is melded about fastener 22 and which has a vertical dimension which is slightly less than the vertical distance between shoulder 70 and bottom surface 86.

Referring again to FIGS. 1 and 2, removal and replacement of electrical components, i.e. the flash tube 18 and/or the circuit board 20 is accomplished by 1) removing the globe 14 from the base 12, 2) removing the screw 55 from the post 48 and disengaging the vertical card 46 and the flash tube 18 therewith from the mounting pins 60 by lifting the vertical card upwardly and away from the base 12, and 3) removing nuts 78 from fasteners 22 and lifting the circuit board 20 upwardly above post 48 and away from the base 12. Replacement of the aforementioned components is accomplished simply by reversing these previous steps. Thus, removal and replacement of these electronic components may be accomplished without having to remove the base 12 from the vehicle and without having to disturb the connection of the vehicle electrical system to the base.

What is claimed is:

1. A light assembly for a vehicle having an inner surface, an outer surface and a conductive lead having a connecting portion for conducting an electrical output from a power supply of the vehicle, said light assembly comprising:

a. a housing having a light transparent portion, and including a base which is adapted to be fixedly mounted to the vehicle, and a cover which is attached to said base, said base being formed by a wall having an inner surface, an outer surface and at least one through-hole which has an inner surface and which extends between said inner surface and said outer surface of said wall;

b. indicating means located inside said housing, said indicating means including:

(1) an indicating member which is mounted to said base and which provides a visual output through said light transparent portion, (2) circuit board means having (i) a conductive portion and (ii) electronic components which are fixedly mounted to said conductive portion and which are in electrical communication with said indicating member and which cause said indicating member to generate said visual output in response to the electrical output from the power supply;

c. means for fastening said circuit board means and said conductive lead to said base in a manner to conduct said electrical output between said vehicle power supply and said circuit board means, said fastening means including an electrically conductive elongated member having:

(1) a middle portion fixedly mounted in said base wall through-hole, (2) a head portion which faces outwardly from the outer surface of said base wall and which is adapted to be connected to said connecting portion of said conductive lead, (3) a shaft portion which faces inwardly from said inner surface of said base wall and which engages said circuit board means in a manner that said shaft portion is in electrical communication with the conductive portion of said circuit board means, and (4) an end connector which is attached to said shaft portion to engage said circuit board means to said shaft portion in a manner that disengagement of said end connector permits said circuit board means to be removed from said shaft portion.

2. The light assembly as set forth in claim 1 wherein:

a. said elongated fastener member includes a longitudinal axis, and a transverse axis which is perpendicular to said longitudinal axis; and b. said elongated fastener member includes a shoulder portion which has a substantial alignment component which is generally parallel to said transverse axis and which engages said circuit board means to support said circuit board means on said base.

3. The light assembly as set forth in claim 2 wherein said middle portion of said electrically conductive member includes an outer surface which is fixedly attached to said inside surface of said base wall through-hole.

4. The apparatus as set forth in claim 2 wherein said head portion of said elongated fastener member includes a slotted female conductive receptacle for receiving a male conductive fitting therein to engage said connecting portion between said male fitting and said head portion and to provide an electrically conductive path between said conductive lead and said elongated fastener member.

5. The light assembly as set forth in claim 3 wherein:

a. said base wall includes a laterally extending bottom wall which is joined to an upstanding sidewall;

b. said connecting portion is located in a manner exterior to the outer surface of said vehicle; and c. said outer surface of said bottom wall is fixedly mounted above the outer surface of the vehicle and above the connecting portion.

6. The light assembly as set forth in claim 3 wherein:

a. said connecting portion of said conductive lead includes an electrically conductive loop portion; and b. said male conductive fitting is a threaded screw which engages said conductive loop and is threadably engaged within a threaded portion of said slotted female receptacle.

7. The light assembly as set forth in claim 3 wherein:

a. said end connector is a threaded nut which is threadably engaged to said shaft portion; and b. said elongated fastener member includes a conductive washer which is engaged to said shaft portion and which engages a surface of said circuit board means in a manner that the conductive washer is in conductive contact with the conductive portion of the circuit board means to provide a conductive path between said elongated fastener member and said circuit board means.

8. The apparatus as set forth in claim 6 wherein said indicating member is removably mounted to said base above said circuit board means in a manner that removal of said indicating member from said base provides a path for removal of said circuit board means from said base, said indicating member including an upstanding support member having a lower end which is mounted to said base and an upper end which includes an indicating light.

9. The apparatus as set forth in claim 7 wherein:

a. said upstanding support member extends through an opening in said circuit board means; and b. said lower portion of said indicating member is removably connected to said upstanding support member in a manner that removal of said indicating member from said support member and removal of said end connectors from said shaft portions permits said circuit board means to be removed from said shaft portion in a direction upwardly from said upstanding support member to remove said circuit board means from said base.

10. In a light unit including a base with an inner surface and an outer surface, a light transparent cover, light emitting means, a circuit board, and an electrically conductive fastener member having a head portion, a middle portion and a shaft portion, a method of assembling and attaching the light unit to the outside of a vehicle having a conductive lead with a connecting portion located outside the vehicle for conducting an electrical output from a power supply of the vehicle, the method comprising the steps of:

a. joining the middle portion of the electrically conductive fastener to the base so that (i) the head portion faces outwardly from the outer surface of the base and (ii) the shaft portion extends upwardly from the inner surface of the base;

b. placing the circuit board in a substantially horizontal manner onto the shaft portion so that a hole in the circuit board is placed over the shaft portion so that the shaft portion extends upwardly through the hole, with the circuit board being supported on the shaft portion by a substantially horizontal shoulder portion of the shaft portion, so that the shaft portion is in electrical communication with an electrically conductive portion of the circuit board;

c. releasably attaching the circuit board to the shaft portion;

d. releasably attaching the indicating member to the light unit above the circuit board and in electrical communication with the conductive portion of the circuit board;

e. removably attaching the transparent cover to the base;

f. mounting the base to the vehicle; and g. releasably attaching the connecting portion of the conductive lead to the head portion of the fastener so that the vehicle power supply is in electrical communication with the indicating member.

11. The method as set forth in claim 10 wherein during the step of releasably attaching the circuit board to the shaft portion, a shaft fastener is engaged to the shaft portion above the circuit board to engage the circuit board between the shoulder portion and the shaft fastener.

12. The method as set forth in claim 11 wherein during the step of releasably attaching the indicating member to the base, a vertical circuit support member having an upper end to which the indicating light is attached and in electrical communication, is removably electrically engaged to a conductive member upstanding from the base in a manner that the upstanding member is in electrical communication with the circuit board.

13. The method as set forth in claim 12 wherein during the step of claim 13 the vertical circuit card is releasably engaged to a vertical post which extends from the base upward through a vertical opening in the horizontal circuit board at a location above the circuit board.

14. The method as set forth in claim 13 additionally comprising the step of removing the horizontal circuit board by the steps consisting of:

a. removing the transparent cover;
b. removing the indicating member; and
c. removing the shaft fasteners from the shaft portions and removing the horizontal circuit board upwardly from the shaft portions and away from the base.

* * * * *